US007992512B2

(12) United States Patent
Rodriguez et al.

(10) Patent No.: US 7,992,512 B2
(45) Date of Patent: Aug. 9, 2011

(54) BOAT MOUNTED INTERFACE FOR DIRECTING A BEND IN A FLEXIBLE ELEMENT

(75) Inventors: Lucio Rodriguez, Detroit Lakes, MN (US); Nicholas A Gargaro, III, Coon Rapids, MN (US); David M Wendinger, Isanti, MN (US)

(73) Assignee: Nicholas A. Gargaro, III, Lino Lakes, MN (US)

( * ) Notice: Subject to any disclaimer, the term of this patent is extended or adjusted under 35 U.S.C. 154(b) by 286 days.

(21) Appl. No.: 12/383,875

(22) Filed: Mar. 29, 2009

(65) Prior Publication Data

US 2010/0242827 A1 Sep. 30, 2010

(51) Int. Cl.
*B63B 17/00* (2006.01)

(52) U.S. Cl. ..... 114/364

(58) Field of Classification Search ..... 114/173, 114/174, 343, 364
See application file for complete search history.

(56) References Cited

U.S. PATENT DOCUMENTS

| | | | | |
|---|---|---|---|---|
| 4,534,307 | A * | 8/1985 | Overs | 114/343 |
| 5,919,067 | A * | 7/1999 | Smith | 440/2 |
| 7,013,831 | B1 * | 3/2006 | Garelick | 114/364 |
| 7,779,773 | B2 * | 8/2010 | Little et al. | 114/364 |

* cited by examiner

*Primary Examiner* — Daniel V Venne

(57) ABSTRACT

An interface between the gunwale or other surface of a boat and a tool such as a electronic device such as a fish finder. The interface is tucked under the mount of the electronic device and includes an opening running radially from the interior of the interface to and beyond an outer diametrical portion of the mount such that a power cord and/or other electrical connections can run from a power source in an inner portion of the boat, then to a central portion of the interface, then to the portion of the interface disposed beyond the outer diametrical portion of the mount, and then to the electrical device.

15 Claims, 1 Drawing Sheet

BOAT MOUNTED INTERFACE FOR DIRECTING A BEND IN A FLEXIBLE ELEMENT

FIELD OF THE INVENTION

The present invention generally relates to an interface, more particularly to a nautical interface, and specifically to an interface between a portion of a boat and an electronic device for directing a bend in a flexible element such as an electrical wire.

BACKGROUND OF THE INVENTION

A fish finder is one example of an electronic device used on a boat. A fish finder is a relatively expensive device and hence usually is not left unattended on the boat. Rather, the fish finder is removed from its mount, such as a quick mount, and locked in a vehicle or stored elsewhere when the fisherman is on land.

The mount itself, however, is a rather permanent part of the boat. Holes are drilled in the boat for the mount. Such holes are relatively small, albeit permanent. A relatively large hole is also drilled in the boat for the power cord and/or for other electrical connections. This hole is also permanent.

SUMMARY OF THE INVENTION

A feature of the present invention is the provision in a boat mounted interface for directing a bend in a flexible element, of the interface including a body and a projecting portion offset from the body, and of openings in the body and projecting portion such that a flexible element can run into a lower surface of the body, through the body and projecting portion, and out of an upper surface of the projecting portion.

Another feature of the present invention is the provision in a boat mounted interface for directing a bend in a flexible element, of a body being C-shaped and having a first opening disposed centrally, of the body having two ends confronting each other and spaced from each other so as to define a second opening, and of a projecting wall extending to and between the two ends and extending outwardly of the body and defining a third opening such that a flexible element can run into the body via or through the first opening, through the body and into the third opening via or through the first and second openings, and out of the third opening.

Another feature of the present invention is the provision in a boat mounted interface for directing a bend in a flexible element, of a set of three openings, with a first opening extending through a first or lower side of the interface, with a third opening extending through a second or upper side of the interface, and with a second opening extending radially from the first opening to the third opening such that the interface may receive and direct a bend in the flexible element.

Another feature of the present invention is the provision in a boat mounted interface for directing a bend in a flexible element, of a keyhole opening for receiving and directing a bend in the flexible element.

Another feature of the present invention is a method for mounting on a boat an interface for directing a bend in a flexible element, where the method includes the steps of defining a perimeter area on the boat that will align with the perimeter of the interface, making a set of pin connector holes in the boat in the perimeter area for engaging the interface to the boat with pin connectors, and making another hole in the boat in the perimeter area for the flexible element.

Another feature of the present invention is the provision in a boat mounted interface for directing a bend in a flexible element, of the interface being an integral part of a mount, where the mount is a quick mount for a device such as a fish finder.

An advantage of the present invention is that the hole that is drilled in the boat for the flexible element or electrical cord is shielded from water, dirt, and fish parts.

Another advantage of the present invention) is that interface contains and thus protects the flexible element.

Another advantage of the present invention is that the hole that is drilled in the boat for the flexible element is drilled within a certain perimeter, where the certain perimeter matches the perimeter of the interface, such that the larger hole of the flexible element is drilled between holes for the pin connector holes. This saves space, and in a sense makes space, on a boat where space is at a premium.

Another advantage of the present invention is that the hole that is drilled in the boat for the flexible element or electrical cord is hidden. The result is a more attractive boat.

Another advantage of the present invention is safety. The flexible element or electrical cord is directed upwards at a location close the mount for the electrical device. This provides a more tidy, and thus more safe, environment, in a boat where space is at a premium.

Another advantage is that the interface, having pin connector holes, may be used as a jig or template for drilling the pin connector holes in the boat. The interface has a set of pin connector holes that align up with pin connector holes in the mount with which the interface will engage. Pin connectors pass through the mount, then pass through the interface, and then pass through the pin connector holes that are made in the boat. The pin connectors may engage the holes that are made in the boat or may engage connectors such as nuts on an inside portion of the boat.

Another advantage is that the interface may include a number of pin connector or bolt patterns for a wide variety of mounts having different bolt patterns.

Another advantage is that the interface may be used for a great number of implements such as depth finders, radios or antennas, fish finders, global positioning sensors, and air and water temperature sensors.

DETAILED DESCRIPTION

Figure 1A:
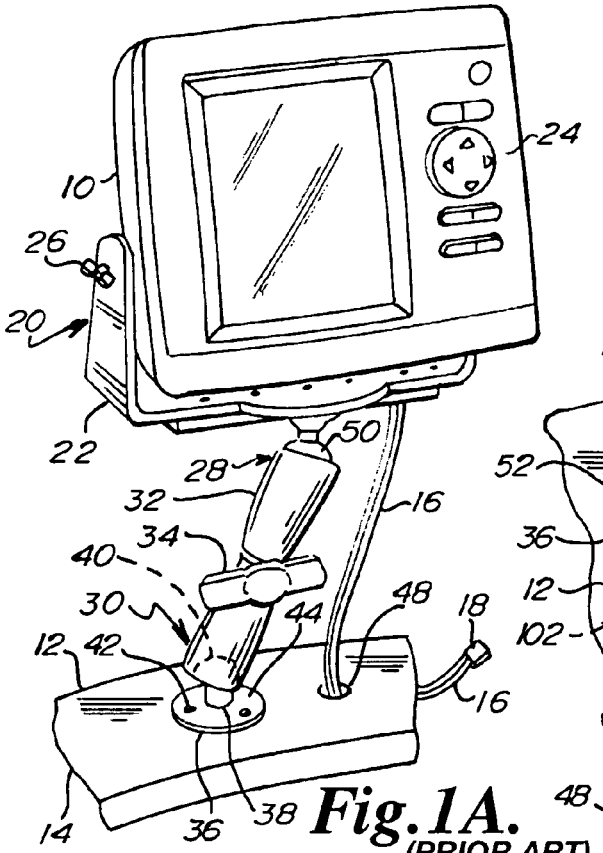
Fig.1A. (PRIOR ART)
FIG. 1A is a perspective view of a prior art apparatus and prior art method for fixing an electronic implement to a gunwale of a boat.

FIG. 1A shows an electrical device or electrical implement 10, namely a fish finder, mounted on a gunwale 12 of a boat 14. The fish finder 10 includes an electrical cord or set of electrical wires or flexible element 16 having a relatively large end connection 18 for plugging into a power source or for mating with one of a great variety of electrical platforms.

The fish finder 10 is engaged on a mount 20. Mount 20 includes a U-shaped holder portion 22 pivotally engaging a housing 24 of the fish finder 10 via swivel connections 26. Mount 20 further includes a double ball and socket portion having a first upper ball and socket joint 28, a second lower ball and socket joint 30, and an arm 32 between the ball and socket joints 28 and 30. Arm 32 includes a handle 34 that, when turned in a rotating fashion, opens up one or more of the socket portions of the joints 28, 30 so as to capture and release the ball portions of the joints 28, 30. Mount 20 further includes a base or base portion 36 on which a stem or stem portion 38 and ball or ball portion 40 is engaged. Ball or ball portion 40 forms the ball portion of the second lower ball and socket joint 30. Base 36 includes a set of holes 42 for pin connectors 44 for mounting base 36 and mount 20 to the gunwale 12 of the boat 14. Mount 20 as a whole may be referred to as a quick mount. Base 36, stem 38 and ball 40 are integral and one-piece and such piece can be referred to in and of itself as a quick mount.

Figure 1C:
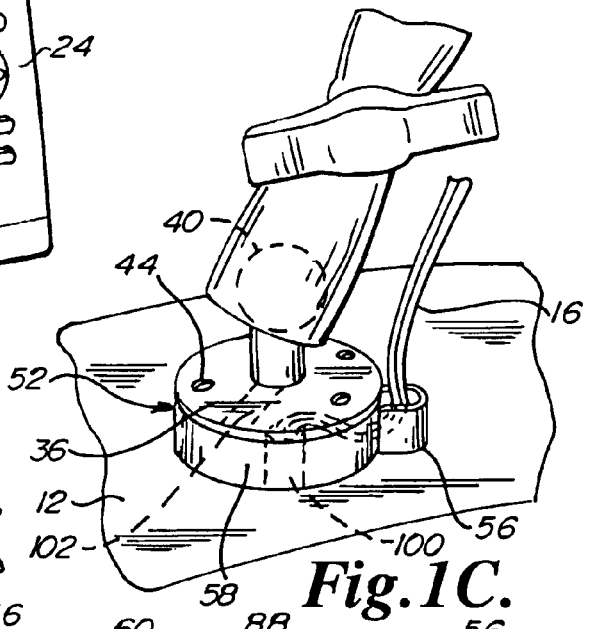
FIG. 1C is a perspective view of the present boat mounted interface for directing a bend in a flexible element, showing the interface between the gunwale of a boat and the base of a mount for an electronic implement.
Figure 1E:
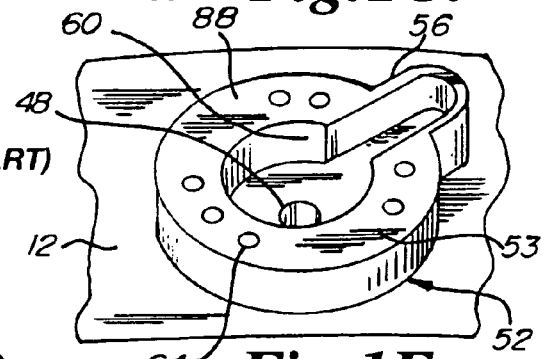
FIG. 1E is a perspective view of the interface of FIG. 1C, with the base of the mount removed, and shows the body of the interface disposed centrally about the relatively large hole for the electrical wire or wires of the electronic implement.
Figure 1F:
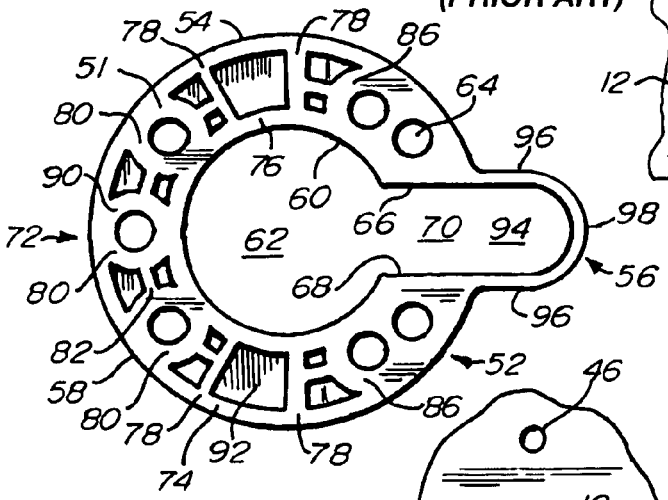
FIG. 1F is a bottom plan view of the interface of FIG. 1C.
Figure 1D:
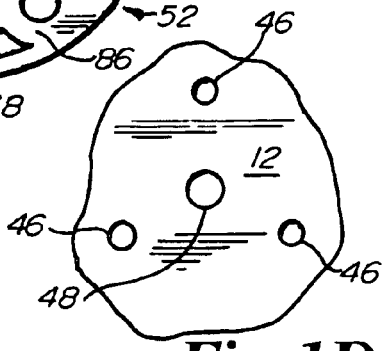
FIG. 1D is a top plan view of a gunwale of a boat showing a relatively large hole drilled inside of an area where three pin connector holes are drilled, and thus illustrates the result of the present method for fixing an electronic implement to a gunwale of a boat.
Figure 1B:
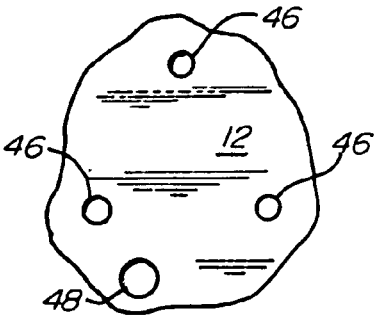
Fig.1B. (PRIOR ART)
FIG. 1B is a top plan view of a gunwale of a boat showing a relatively large hole drilled outside of an area where three pin connector holes are drilled, and thus illustrates the result of a prior art method for fixing an electronic implement to a gunwale of a boat.

Prior to engaging the mount 20 and fish finder 10 on the boat 14 in a prior art method of engagement as shown in FIG. 1A, a set of four prior art holes, as shown in FIG. 1B, are drilled into the boat 14, usually into the gunwale 12. Three of these holes are pin connector holes 46 of relatively small diameter for receiving and/or engaging pin connectors 44. One of these holes is a flexible element hole 48 of relatively great diameter for receiving flexible element 16 and for further receiving and letting pass through the end connection 18 which may be of a greater diameter than the non-end cord portion of the flexible element 16. Then the piece having the base 36, stem 38 and ball 40 is fixed to the three holes 46 with pin connectors 44 such as screws. Then handle 34 is then operated to open up the socket portion of the ball and socket 30 and the socket portion of the ball and socket 28. Then the socket portions are engaged with their respective balls of the joints 28, 30, whereupon the handle 34 is turned to close the sockets and tie in the balls of the joints 28, 30. Like ball or ball portion 40 is fixed rigidly to the gunwale 12 of boat 14, ball or ball portion 50 of ball and socket joint 28 is fixed rigidly to the U-shaped holder 22 that engages the fish finder 10.

In the arrangement shown in FIG. 1A utilizing the prior art hole set-up of FIG. 1B, flexible element 16 is spaced relatively far from arm 32 and opening or hole 48 is spaced a relatively great distance from holes 46, the locations of which are shown by the locations of the pin connectors 44. As can further be appreciated from such an arrangement, flexible element 16 is likely given a great amount of slack or looseness such that the fish finder 10 can be swung to the viewer's left. While swinging the fish finder 10 to the right is likely to be unhampered by a length of the flexible element 16 because hole 48 is located to the viewer's right, swinging the fish finder 10 to the viewer's left may likely require a greater length of the flexible element 16, which, if not available, may tighten the flexible element 16 and cause it to become unplugged from either of its end connections.

As shown in FIGS. 1C, 1E and 1F, the present boat mounted interface for directing or guiding a bend in a flexible element is indicated by the reference number 52. Interface 52 is engaged between base 36 and the gunwale 12 of a boat 14, with the interface 52 having a first or lower side 51 confronting the gunwale 12 and a second or upper side 53 confronting the base 36. Interface 52 includes a generally C-shaped body 54 and a projecting wall 56 that is integral and one-piece with the body 54. Projecting wall or portion 56 is offset from the body 54.

Body 54 includes an outer perimeter 58 and an inner boundary 60. Outer perimeter 58 defines a segment of a circle. Inner boundary 60 defines a segment of a circle. Inner boundary 60 is coaxial with outer boundary 58 and is spaced from and runs or extends parallel to the outer perimeter 58. Inner boundary 60 defines a first through opening 62 that is disposed centrally in the body 54. First through opening 62 extends through each of the lower and upper surfaces 51, 53 of the interface 52.

Body 54 includes a set of pin connector holes 64 disposed between the outer perimeter 58 and inner boundary 60. The pin connector holes 64 extend in the height direction such that the pin connectors 44 can run from the base 36, through the body 54, and into the holes 46 in the gunwale 12 to fasten or engage the interface 52 to a boat.

Body 54 further includes a first end 66 and a second end 68. Ends 66 and 68 confront or are adjacent to each other and are spaced from each other. Ends 66 and 68 define a second through opening 70 therebetween. Second through opening 70 extends through each of the lower and upper openings 51, 53 of the interface 52. First and second through openings 62 and 70 lead into or communicate with each other. Second through opening 70 extends radially relative to first through opening 62.

Body 54 further includes a network of ribs between the outer perimeter 58 and inner boundary 60. Rib 74 is in the nature of an outer wall defining the outer perimeter 58. Rib 76 is in the nature of an inner wall defining the inner boundary 60. Ribs 78 extend radially relative to the central first through opening 62 and extend to and between the outer wall or rib 74 and inner wall or rib 76. Ribs 80 are cylindrical, form some of the pin connector holes 64, and tie the outer wall or rib 74 with the inner wall or rib 76. Ribs 82 run coaxial with respect to outer wall or rib 74 and inner wall or rib 76 and are disposed medially of ribs 74 and 76. Ribs 86 form partial cylinders about some of the pin connector holes 64.

Body 54 includes an upper surface 88 and a lower surface 90 that are co-planar with the interface surfaces 53 and 51, respectively. Surfaces 88 and 90 are flat and run parallel to each other. Pin connector holes 64 run through each of the upper and lower surfaces 88 and 90.

Body 54 includes cavities 92. Some of the cavities 92 are relatively large. Some of the cavities 92 are relatively small. Cavities 92 are open relative to the lower surface 90. Cavities 92 are closed relative to the upper surface 88.

One purpose of the rib network 72 is to minimize the weight of the interface 52. Another purpose of the rib network 72 is to provide a number of pin connector holes 64 so as to align with a relatively great number of bases 36 of different mounts. Another purpose of the rib network 72 is to minimize the amount of material through which to drill to make pin connector holes where the holes 42 of the base 36 do not align with the pre-drilled holes 64 of the body 54. Another purpose of the rib network 72 is to maintain the integrity of the body 54 even though some of the ribs may be drilled through when creating additional pin connector holes.

It should be noted that body 54 includes a set of seven pin connector holes 64. The set of seven pin connector holes 64 includes a first subset of two holes 64 adjacent end 66, a second subset of two holes 64 adjacent end 68, and a third subset of three holes 64 generally opposite the second through opening 70. A triangle is defined by selecting any one hole from each of the three subsets and drawing a line between such selected holes. In each of the subsets, the holes 64 confront each other. In each of the subsets, the holes 64 are closer to each other than to holes 64 of other subsets.

Interface 52 further includes the projecting wall 56. Projecting wall 56 extends from first end 66 to second 68, specifically from where the outer wall or rib 74 runs into the ends 66 and 68. The projecting wall 56 is integral and one-piece with the ends 66 and 68 and thus integral and one-piece with the body 54. The projecting wall 56 extends outwardly of the circle defined by the outer perimeter 58. The projecting wall 56 has the same height as the body 54. An upper surface of the projecting wall 56 lies in the same plane as upper surface 88 of the body 54. A lower surface of the projecting wall 56 lies in the same plane as the lower surface 90 of the body 54. The projecting wall 56 defines a third through opening 94. Third through opening 94 extends through each of the lower and upper sides 51, 53 of the interface 52. Openings 70 and 94 lead radially into each other. Third opening 94 is offset in the lateral or radial direction from first opening 62. In other words, if the interface 52 extends in a horizontal plane, then first opening 62 and third openings 94 are on different or offset vertical axes, each of which extends at a right angle to such horizontal plane. Projecting wall 56 includes a pair of generally straight extending portions 96 and a semi-circular portion 98 extending between the straight extending portions 96.

In operation, the particular electronic implement 10 to be utilized is selected. The size of the end connection or plug 18 is measured. The location that the implement 10 will be fixed on the boat 10 is selected. Then the hole 48 is drilled in the boat 14, such as in the gunwale 12, at the desired location for implement 10, ensuring that the hole 48 is of sufficient size for the end connection or plug 18. Then the particular quick mount to be utilized is selected, and the base 36 of this particular quick mount is aligned with the interface 52 to determine if the pin connector holes 42 of the base 36 match up with any of the pin connector holes 64 of the interface 52. If so, then these pin connector holes 64 are marked, the base 36 is set aside temporarily, and the interface 52 is used as a jig or template by the steps of 1) aligning the center of opening 48 with the center of opening 62, 2) rotating the interface 52 until the projecting wall 56 is at the desired location relative to the electrical implement 10 or relative to where an end of the flexible element or wire or wires will be plugged into the electrical implement 10, and 3) with the interface 52 centered and rotated, passing the drill bit through the marked pin connector holes 64 and drilling into the boat 14. The result is a set of four holes as shown in FIG. 1D, where the three pin connector holes 46 may define an equilateral triangle, with the flexible connector opening 48 being disposed equidistant from each of the three pin connector holes 46. Then the piece having the ball 40, stem 38 and base 36 is picked up and placed on top of the interface 52 such that a perimeter of the base 36 is aligned with the outer perimeter 58 of the body 54. Then pin connectors 44, such as screws, are set into the pin connector holes 42 of the base 36, pass through the pin connector holes 64 of the interface 52, and may bite into the edges of the pin connector holes 46 or may engage nuts disposed on the opposite side of the gunwale 12. Then the remainder of the quick mount is set onto the piece having the ball 40, stem 38 and base 36 and, if not already engaged to the remainder of the quick mount, the electrical implement 10 is engaged to the quick mount. Then the end connection 18 is fed into the third through opening 94, radially through the second through opening 70, into the first through opening 62, down into the opening 48, and then through interior portions of boat 14 to a power source or to an electrical platform. In this final arrangement, flexible element 16 is contained by the interface 52 in part and by the base 36 in part. In this final arrangement, flexible element 16 runs generally longitudinally into the interface 52, runs generally laterally through the interface 52, and runs generally longitudinally out of the interface 52. In this final arrangement, hole 48 is shielded from dirt and grime and water by the interface 52 in part and by the base 36 in part. In this final arrangement, flexible element 16, running upwardly from the projecting wall 56, preferably confronts the quick mount 20 as a whole and preferably confronts individual portions of the quick mount 20 such as base 36, stem 38, ball 40, ball and socket joint 30, arm 32, handle 34, ball and socket joint 28, and ball 50. At ball 50, a quick tie may be used to engage the flexible element 16. Upwardly beyond the ball 50, the flexible element 16 is be permitted to travel to the portion of the electrical implement 10 where the flexible element is electrically engaged.

It should be noted that the flexible element 16 may first be fed from underneath the gunwale 12 into the opening 48, then through openings 62, 70 and 94, and then out of opening 94 and up to the electrical implement 10.

It should be noted that end connection 18 may be relatively large and may be of a size greater than the third opening 94 defined by the projecting wall 56. In this case, after the step of drilling the pin connector holes 46 and prior to the step of engaging the base 36 to the top of the interface 52, the end connection 18 may be fed through the first through opening 62 and further fed through the opening 48, whereupon the flexible element 16 is flexed by hand such that a portion of the flexible element 16 runs radially X through second through opening 70 and into and out of third through opening 94. Then the base 36 is placed on top of the flexible element containing interface 52 and the base 36 and interface 52 is fixed to the boat 14. In this arrangement, the flexible element 16 remains with the boat 14 when the electrical implement 10 is removed from the boat. In this arrangement, the vast majority of the length of the flexible element 16 is pulled to an out-of-the-way location into an interior of the boat 14, with the remaining plug or end connection that is too large to pass through the third through opening remaining on top of the projecting wall 56.

It should be noted that interface 52 may be combined in a one-piece and integral arrangement with the base 36, stem 38 and ball 40 so as to take the form shown in FIG. 1C without the line of demarcation between the interface 52 and the base 36. In this arrangement, interface 52, base 36, stem 38 and ball 40 are molded in one-piece, and the first opening 62 is offset laterally or radially from the third opening 94. In a modified arrangement of this integral one-piece combination, projecting wall 56 may not exist, thus leaving the second through opening 70 to lead to the atmosphere directly through outer wall 74, as indicated on another portion of the periphery by phantom opening 100 in FIG. 1C. In this modified form too, first opening 62 is offset laterally or radially from new third opening 100. In another modified form of this integral one-piece combination, the outer wall 74 may extend 360 degrees about the interface portion 52 and second opening 70 may pass vertically through the base 36, as shown by phantom opening 102 in FIG. 1C. In this further modified form as well, first opening 62 is offset laterally or radially from new third opening 102.

It should be noted that opening 48 is usually preferred to be of a size sufficiently large to permit cable connectors to pass through.

It should be noted that the projecting wall 56 forms the third through opening 94 and that this third through opening 94 can be referred to as a cable cove. A cove can be a place that shelters and protects.

Interface 52 is preferably formed of plastic. Interface 52 is preferably molded. If formed of one-piece to make a piece having interface 52, base 36, stem 38 and ball 40, such a piece may be formed of a rubber or rubber containing material or elastomer or elastomer containing material.

It should be noted that the provision of through openings for each of the first, second and third openings 62, 70, and 94, i.e., openings that extend through each of the first and second sides 51, 53 of the interface 52, maximizes the size of such openings. The upper end of the first opening 62 is closed off by the base 36, and a portion of the lower end of the first opening 62 is closed off by the gunwale 12. The upper end of the second opening 70 is closed off by the base 36 and the lower end of the second opening 70 is closed off by the gunwale 12 of the boat 14. The lower end of the third opening 94 is closed off by the gunwale of the boat 14. Since such openings are through openings which are closed or partially closed as indicated above, the size of such openings are maximized and it is easier to feed and slip the end connection 18 of the flexible element 16 into and through such openings 62, 70 and 94.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A boat mounted interface for guiding a bend in a flexible element, with the interface having a first side and a second side, with the second side being opposite of the first side, with the interface comprising:

a) a body comprising:
- i) an outer perimeter;
- ii) an inner boundary, with the inner boundary defining a first opening, with the first opening extending through the first side of the interface;
- iii) pin connector holes in the body between the outer perimeter and inner boundary, with the pin connector holes extending to and between the first and second sides whereby pin connectors can fasten the interface to a boat;
- iv) a first end; and
- v) a second end, with said second end being adjacent to and being spaced from the first end so as to define a second opening;

b) a projecting wall extending from the first end to the second end, with the projecting wall being integral and one-piece with the first and second ends, with said projecting wall extending outwardly of said first and second ends, and with the projecting wall defining a third opening extending through the second side of the interface, with the third opening being offset from the first opening;

c) wherein the first opening leads into the second opening which leads into the third opening whereby the flexible element can extend into the interface through the first opening, can then extend to the second opening, can then extend to the third opening, and can then extend out of the interface through the third opening; and d) wherein the body is C-shaped, wherein the outer perimeter defines a segment of a circle, and wherein the projecting wall extends outwardly of said circle defined by the outer perimeter.

2. The boat mounted interface of claim 1, wherein the inner boundary defines a segment of a circle, and with the inner boundary being spaced from and extending parallel to the outer perimeter.

3. The boat mounted interface of claim 1, wherein the first opening is a through opening so as to extend through each of the first and second sides of the interface.

4. The boat mounted interface of claim 1, wherein the first opening leads into the second opening which leads radially into the third opening.

5. A boat mounted interface for guiding a bend in a flexible element, with the interface having a first side and a second side, with the second side being opposite of the first side, with the interface comprising:

a) a body comprising:
- i) an outer perimeter;
- ii) an inner boundary, with the inner boundary defining a first opening, with the first opening extending through the first side of the interface;
- iii) pin connector holes in the body between the outer perimeter and inner boundary, with the pin connector holes extending to and between the first and second sides whereby pin connectors can fasten the interface to a boat;
- iv) a first end; and
- v) a second end, with said second end being adjacent to and being spaced from the first end so as to define a second opening;

b) a projecting wall extending from the first end to the second end, with the projecting wall being integral and one-piece with the first and second ends, with said projecting wall extending outwardly of said first and second ends, and with the projecting wall defining a third opening extending through the second side of the interface, with the third opening being offset from the first opening;

c) wherein the first opening leads into the second opening which leads into the third opening whereby the flexible element can extend into the interface through the first opening, can then extend to the second opening, can then extend to the third opening, and can then extend out of the interface through the third opening; and d) wherein the body and projecting wall have a same height.

6. A boat mounted interface for guiding a bend in a flexible element, with the interface having a first side and a second side, with the second side being opposite of the first side, with the interface comprising:

a) a body comprising:
- i) an outer perimeter;
- ii) an inner boundary, with the inner boundary defining a first opening, with the first opening extending through the first side of the interface;
- iii) pin connector holes in the body between the outer perimeter and inner boundary, with the pin connector holes extending to and between the first and second sides whereby pin connectors can fasten the interface to a boat;

iv) a first end; and v) a second end, with said second end being adjacent to and being spaced from the first end so as to define a second opening;

b) a projecting wall extending from the first end to the second end, with the projecting wall being integral and one-piece with the first and second ends, with said projecting wall extending outwardly of said first and second ends, and with the projecting wall defining a third opening extending through the second side of the interface, with the third opening being offset from the first opening;

c) wherein the first opening leads into the second opening which leads into the third opening whereby the flexible element can extend into the interface through the first opening, can then extend to the second opening, can then extend to the third opening, and can then extend out of the interface through the third opening; and d) wherein the second opening is a through opening so as to extend through each of the first and second sides of the interface.

7. A boat mounted interface for guiding a bend in a flexible element, with the interface having a first side and a second side, with the second side being opposite of the first side, with the interface comprising:

a) a body comprising:

i) an outer perimeter;

ii) an inner boundary, with the inner boundary defining a first opening, with the first opening extending through the first side of the interface;

iii) pin connector holes in the body between the outer perimeter and inner boundary, with the pin connector holes extending to and between the first and second sides whereby pin connectors can fasten the interface to a boat;

iv) a first end; and v) a second end, with said second end being adjacent to and being spaced from the first end so as to define a second opening;

b) a projecting wall extending from the first end to the second end, with the projecting wall being integral and one-piece with the first and second ends, with said projecting wall extending outwardly of said first and second ends, and with the projecting wall defining a third opening extending through the second side of the interface, with the third opening being offset from the first opening;

c) wherein the first opening leads into the second opening which leads into the third opening whereby the flexible element can extend into the interface through the first opening, can then extend to the second opening, can then extend to the third opening, and can then extend out of the interface through the third opening; and d) wherein the third opening is a through opening so as to extend through each of the first and second sides of the interface.

8. A boat mounted interface for guiding a bend in a flexible element, with the interface having a first side and a second side, with the second side being opposite of the first side, with the interface comprising:

a) a body comprising:

i) an outer perimeter;

ii) an inner boundary, with the inner boundary defining a first opening, with the first opening extending through the first side of the interface;

iii) pin connector holes in the body between the outer perimeter and inner boundary, with the pin connector holes extending to and between the first and second sides whereby pin connectors can fasten the interface to a boat;

iv) a first end; and v) a second end, with said second end being adjacent to and being spaced from the first end so as to define a second opening;

b) a projecting wall extending from the first end to the second end, with the projecting wall being integral and one-piece with the first and second ends, with said projecting wall extending outwardly of said first and second ends, and with the projecting wall defining a third opening extending through the second side of the interface, with the third opening being offset from the first opening;

c) wherein the first opening leads into the second opening which leads into the third opening whereby the flexible element can extend into the interface through the first opening, can then extend to the second opening, can then extend to the third opening, and can then extend out of the interface through the third opening; and d) wherein each of the first, second and third openings is a through opening so as to extend through each of the first and second sides of the interface.

9. A boat mounted interface for guiding a bend in a flexible element, with the interface having a first side and a second side, with the second side being opposite of the first side, with the interface comprising:

a) a body comprising:

i) an outer perimeter;

ii) an inner boundary, with the inner boundary defining a first opening, with the first opening extending through the first side of the interface;

iii) pin connector holes in the body between the outer perimeter and inner boundary, with the pin connector holes extending to and between the first and second sides whereby pin connectors can fasten the interface to a boat;

iv) a first end; and v) a second end, with said second end being adjacent to and being spaced from the first end so as to define a second opening;

b) a projecting wall extending from the first end to the second end, with the projecting wall being integral and one-piece with the first and second ends, with said projecting wall extending outwardly of said first and second ends, and with the projecting wall defining a third opening extending through the second side of the interface, with the third opening being offset from the first opening;

c) wherein the first opening leads into the second opening which leads into the third opening whereby the flexible element can extend into the interface through the first opening, can then extend to the second opening, can then extend to the third opening, and can then extend out of the interface through the third opening; and d) wherein each of the first, second and third openings is a through opening so as to extend through each of the first and second sides of the interface, and wherein the first, second and third openings as a whole define a keyhole opening.

10. A boat mounted interface for guiding a bend in a flexible element, with the interface having a first side and a second side, with the second side being opposite of the first side, with the interface comprising:

a) a body comprising:

i) an outer perimeter;

ii) an inner boundary, with the inner boundary defining a first opening, with the first opening extending through the first side of the interface;

iii) pin connector holes in the body between the outer perimeter and inner boundary, with the pin connector holes extending to and between the first and second sides whereby pin connectors can fasten the interface to a boat;

iv) a first end; and v) a second end, with said second end being adjacent to and being spaced from the first end so as to define a second opening;

b) a projecting wall extending from the first end to the second end, with the projecting wall being integral and one-piece with the first and second ends, with said projecting wall extending outwardly of said first and second ends, and with the projecting wall defining a third opening extending through the second side of the interface, with the third opening being offset from the first opening;

c) wherein the first opening leads into the second opening which leads into the third opening whereby the flexible element can extend into the interface through the first opening, can then extend to the second opening, can then extend to the third opening, and can then extend out of the interface through the third opening; and d) wherein the body includes a network of ribs between the outer perimeter and inner boundary, with the pin connector holes extending through the network of ribs.

11. A method for mounting a interface on a boat, with the interface capable of guiding a bend in a flexible element, with the interface having a first side, a second side, a first opening, a second opening, a third opening, and an outer perimeter, with the first opening extending through the first side of the interface, with the third opening extending through the second side of the interface, with the first and third openings being offset laterally from each other, with the second opening extending laterally to and between the first and third openings such that the first, second, and third openings lead into each other, with the method comprising the steps of:

a) making at least a first pin connector hole for a first pin connector into the boat, with said first pin connector hole falling within an area defined by said outer perimeter of the interface; and b) making a flexible element hole for a flexible element into the boat, with said flexible element hole for the flexible element being of sufficient size to receive and let pass therethrough said flexible element, with said flexible element hole for the flexible element being of a size greater than a size of the first pin connector hole, with said flexible element hole for the flexible element falling within an area defined by said outer perimeter of the interface.

12. The method of claim 11, and further comprising the step of making at least a second pin connector hole for a second pin connector into the boat, with said second pin connector hole falling within an area defined by said outer perimeter of the interface.

13. The method of claim 12, and further comprising the step of making at least a third pin connector hole for a third pin connector into the boat, with said third pin connector hole falling within an area defined by said outer perimeter of the interface.

14. The method of claim 13, wherein the flexible element hole for the flexible element is disposed equidistant from each of said first, second, and third pin connector holes.

15. The method of claim 14, wherein the first, second and third pin connector holes define an equilateral triangle, and wherein said flexible element hole for the flexible element is disposed within said equilateral triangle.

* * * * *